US008523379B2

(12) United States Patent
Shay

(10) Patent No.: US 8,523,379 B2
(45) Date of Patent: Sep. 3, 2013

(54) SMART LIGHT

(76) Inventor: Allen Bernard Shay, Pasadena, CA (US)

( * ) Notice: Subject to any disclaimer, the term of this patent is extended or adjusted under 35 U.S.C. 154(b) by 511 days.

(21) Appl. No.: 12/589,813

(22) Filed: Oct. 29, 2009

(65) Prior Publication Data

US 2011/0103045 A1 May 5, 2011

(51) Int. Cl.
*F21L 4/00* (2006.01)
*F21V 21/00* (2006.01)

(52) U.S. Cl.
USPC ..... 362/157; 362/217.01; 362/640; 362/227

(58) Field of Classification Search
USPC ..... 362/157–208, 217.01–217.17, 640–659, 362/227–249.17
See application file for complete search history.

(56) References Cited

U.S. PATENT DOCUMENTS

| | | | | |
|---|---|---|---|---|
| 7,309,965 | B2 * | 12/2007 | Dowling et al. | 315/318 |
| 7,764,026 | B2 * | 7/2010 | Dowling et al. | 315/307 |
| 2005/0047134 | A1 * | 3/2005 | Mueller et al. | 362/231 |
| 2009/0122571 | A1 * | 5/2009 | Simmons et al. | 362/546 |

* cited by examiner

*Primary Examiner* — Evan Dzierzynski
*Assistant Examiner* — Danielle Allen
(74) *Attorney, Agent, or Firm* — Allen B. Shay

(57) ABSTRACT

The extendible multifunction light comprises of several electronic functions which communicates with the use of speaker and microphone with each other based on the specific commands that maybe prompted by the user or by programming such response with the use of the control panel. Each of the functions process data which can be stored in the memory of the product which can be transferred into the user's personal computer. A user may transfer information from his or her computer to download into the product. The product may transform itself from a flare to a flashlight; to be extended for use for walking, hiking and skiing. The product has a camera for recording video and audio information, a GPS system for tracking the user, an MP3 player for downloading music, motion detector, LCD navigator screen, breath analyzer and fingerprint scanner.

28 Claims, 7 Drawing Sheets

SMART LIGHT

BACKGROUND OF THE INVENTION

Field of the Invention

Embodiments of the present disclosure relate to lights and, specifically, to an extendible light with interchangeable tips which provide the light with enhanced functionality.

DETAILED DESCRIPTION OF THE CERTAIN EMBODIMENTS

Embodiments of the present disclosure provide an extendible light with enhanced functionality. In one embodiment, the extendible light is configured so as move between extended and collapsed positions, allowing easy deployment and storage of the extendible light. A plurality of devices, such as lights, may also be interchangeably added or removed from an end of the extendible light in order to expand the capabilities of the extendible light.

The extendible light may be additionally provided with a plurality of electronic devices, which enhance the functionality of the extendible light. Examples, discussed in greater detail below, may include, but are not limited to, transceivers, such as radios and emergency transmitters, sensors, such as air quality and motion sensors, analyzers, such as dna/breath-sensor analyzers, and audio/visual devices, such as electronic displays and speakers. These and other objects and advantages of the extendible light are discussed in greater detail below.

Figure 1A:
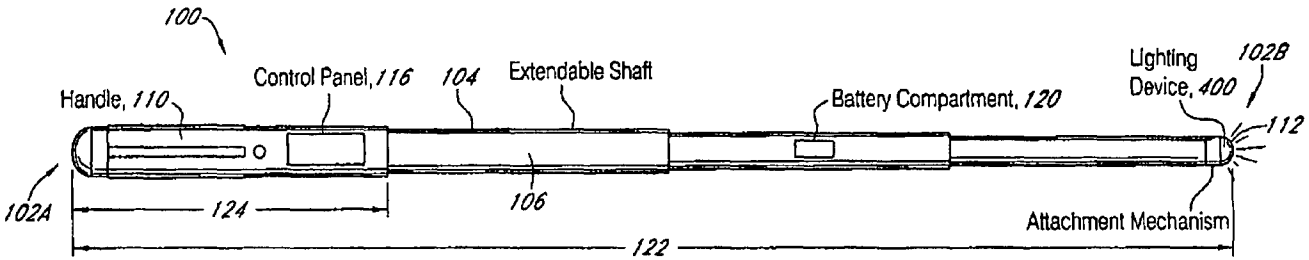
FIGS. 1A-1B illustrates embodiments of an extendible, multifunction light in extended and collapsed positions.
Figure 1B:
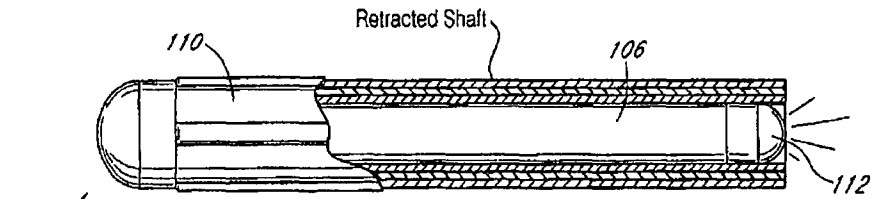

FIGS. 1A-1B illustrates embodiments of the extendible light device 100. In general, the extendible light 100 comprises a generally elongated, cylindrical body 104 having a first end 102A and a second end 102B. The extendible light 100 further comprises a handle 110 at about the first end 102A and a tip 112 positioned at about the second end 102B.

In the embodiment of FIGS. 1A and 1B, the handle 110 is generally elongate and cylindrical and dimensioned so as to be grasped by a user of the extendible light 110. The surface of the handle 110 may be further configured with contours and/or high friction materials, such as rubber, in order to facilitate grasping of the handle 110 by the extendible light user.

In one embodiment, the handle 110 is hollowed in its center, allowing the extendible light 100 to reversibly extend. In an embodiment, the body 104 is divided into a plurality of segments 106 which are capable of reversibly moving between an extended configuration (FIG. 1A) and a retracted configuration (FIG. 1B). In one embodiment, a length 124 of the segments may be approximately 9 inches and a length 122 of the extendible light 100 when in the extended configuration may range between approximately 3 to 6 feet. In the retracted configuration, substantially the entire length of each segment 106 nests within the hollowed center of the handle 110. In the extended configuration, substantially the entire length of each segment is exposed outside the handle 110. Advantageously, the reversibly extendable design of the extendible light 100 allows the extendible light 100 to be retracted when the full length of the extendible light 100 is not required, providing easy storage.

Figure 3:
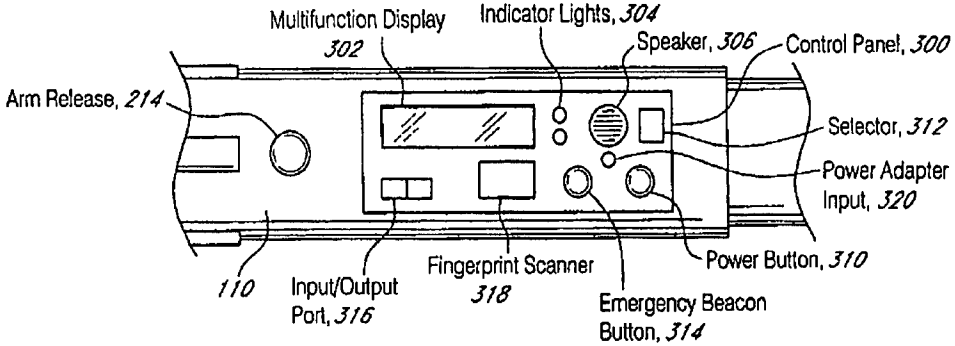
FIG. 3 illustrates an embodiment of a control panel of the extendible light of FIGS. 1A-1B for use in activating a variety of electronic features of the extendible light.

A control panel 116, discussed in greater detail below with respect to FIG. 3, is further provided in the handle 110. The control panel 116 comprises audio and/or video interfaces in communication with a plurality of electronic devices housed within the extendible light 100. Such electronic devices may include, but are not limited to, satellite navigation systems, audio recording and playback devices (e.g. mp3 audio recorders and players), cellular telephones and pagers, wireless communications devices configured for transmitting and receiving data from wireless local area networks and devices (e.g. networks and devices employing the Bluetooth, WiFi, and the IEEE 802.11 standards), time keeping devices (e.g. clocks and alarms), personal information managers (PIMs) which provide calendar and scheduling functions, radio transmitters and receivers, emergency transmitters, video playback devices, motion sensors, DNA and/or breath-sensor analyzers, voice identification devices, and retinal scanners. The control panel 116 and electronic devices may further be in communication with a source of electrical power, such as a battery housed in a battery compartment 120. So configured, the control panel 116 may allow the extendible light user to employ one or more of these electronic devices.

The tip 112 comprises a plurality of devices which are configured to be reversibly interchanged and mounted to the second end 10213 of the extendible light 100 using an attachment mechanism 114. These tips 112 provide the extendible light 100 with different functionalities. In one embodiment, the tip 112 may comprise a lighting device 400. This and other non-limiting embodiments are discussed below with respect to FIGS. 4A-4D. Advantageously, as illustrated in FIG. 1B, when in the retracted position, the tip 112 still possesses a direct line of sight outside the handle. Thus, functions of the tip 112 which require such line of sight, for example, lighting devices 400, may still be employed when the extendible light 100 is in the retracted configuration.

Figure 2A:
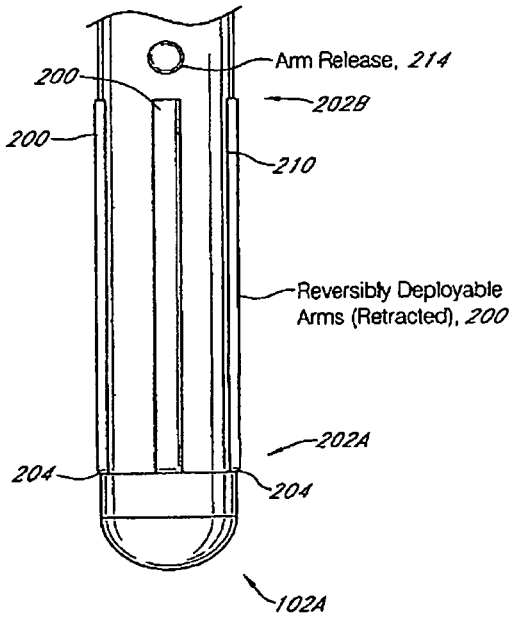
FIGS. 2A-2B illustrates an embodiment of a first end of the extendible light of FIGS. 1A-1B, illustrating reversibly deployable arms in deployed and retracted configurations.
Figure 2B:
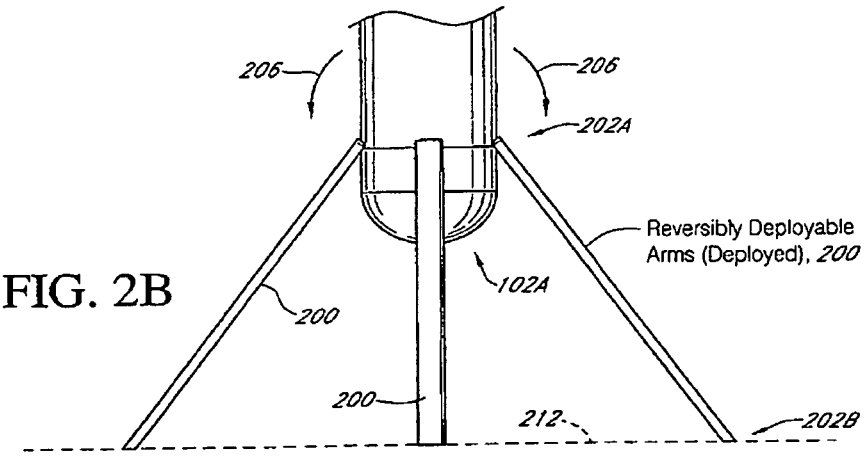

In the embodiment of FIGS. 1A and 1B, the handle 110 is further configured with a plurality of reversibly deployable arms 200, as further illustrated in FIG. 2A-2B. The arms 200 comprise generally elongate shafts having a proximal end 202A and a distal end 202B. The proximal end 202A of the arms 200 are pivotably mounted to the handle 100 at about the first end of the extendible light 102A at a pivot 204.

In a retracted position (FIG. 2A), the length of the arms 200 extend adjacent and substantially parallel to the length of the handle 110. In a deployed configuration, such as in FIG. 28, the distal end 202B of the arms 200 pivot away from the handle 100 (arrows 206) extending downward from the handle 110.

The surface of the handle 100 may be configured with a plurality of recesses 210 which are dimensioned to accommodate at least a portion of the arms 200 within the handle 100 when the arms 200 are in the retracted configuration. Advantageously, in this manner the surface of the handle 100 may remain substantially flat when the arms 200 are in the retracted configuration, allowing the extendible light user to comfortably grasp the handle 110.

The arms 200 are further configured so as to allow the extendible light 100 to be stably stood upright, with the second end 102B extending upwards. In an embodiment, when fully deployed, the distal ends 202B of the arms 200 terminate in substantially the same plane 212. In another aspect, the distal ends 202 of the arms 200 are configured so as to be parallel to the plane 212. Thus, the first end 102A of the extendible light 100 may be placed upon a horizontal surface without fear of the extendible light 100 tipping over, when the arms 200 are fully deployed, The handle 110 further comprises arm release button 214. The arm release button 214 is in communication with a plurality of locking mechanisms (not shown). The locking mechanisms are configured so as to inhibit motion of the arms 200 when the arms 200 are in either of the fully deployed or fully retracted positions. When the arm release button 214 is depressed by the extendible light user, the locking mechanisms are released and the arms 200 may be freely moved between the retracted and deployed positions. As a result, the arms 200 may be positioned, as necessary, in the deployed or retracted positions without additional further movement of the arms 200.

FIG. 3 illustrates one embodiment of a control panel 300 housed in the handle 110 of the extendible light 100. In general, the control panel 300 functions as an interface by which the extendible light user may employ the plurality of electronic devices incorporated into the extendible light 100. For example, the panel 300 may comprise a plurality of audio and visual devices, such as an electronic, multifunction display 302 (e.g. a liquid crystal display), a plurality of indicator lights 304, and/or a plurality of speakers 306. The panel 300 may further comprise a plurality of buttons or switches, such as power buttons 310 to activate electrical power to one or more of the electronic devices, power adapter input 320, a selector 312 for selecting options when using one or more of the electronic devices, and/or emergency signal activation button 314 which may be employed to activate an emergency transmitter device housed within the extendible light 100.

The control panel 300 may further comprise a plurality of other devices which facilitate the function of the electronic devices. In one example, the control panel 300 may comprise input/output ports 316 as are known in the art for transferring electronic data, such as flash memory card readers, universal serial bus (USB) ports, and IEEE 1394 (Firewire, iLink) ports. In another example, the control panel 300 may comprise a fingerprint scanner and/or retinal scanner 318 in communication with the multifunction display. The scanner 318 may compare an individual's newly scanned fingerprint and/or retinal scan with others stored within the scanner 318 or other databases in communication with the scanner 318 in order to identify the identity the individual. This identity information may further be used to allow or deny access to the features of extendible light 100. In other embodiments, the control panel 300 comprises fewer or additional interfaces to electronic devices, such as one or more of the interfaces discussed above.

In another embodiment, the control panel 300 may comprise analyzers for DNA and/or breath. Such analyzers may be employed in order to evaluating blood alcohol level or the presence of drugs in the subject's system. The DNA analyzer may comprise a plurality of components which receive samples containing DNA, such as blood. The breath analyzer may comprise a plurality of component which receives a breath sample, such as a mouthful of air, Upon performing an analysis on the provided sample, the analyzers provide the results of the analysis. In one embodiment, the results may be displayed on the multifunction display 302. In another embodiment, the results may be electronically output through the input/output ports 316. The DNA and breath/sensor analyzer may further comprise a data structure, such as a database, which compares reference samples to a new sample to determine to whom or what a DNA or breath-sensor analysis consisting of alcohol or drug sample results may be.

It may be understood that, in other embodiments, the extendible light 100 comprises fewer or additional electronic devices, such as one or more of the electronic devices discussed above.

FIGS. 4A-4D illustrate embodiments of tips 112 which may be reversibly mounted to the second end 102B of the extendible light 100. The tips 112 may be mounted in place by attachment mechanisms 114 configured to engage mating portions of the tips 112. For example, the attachment mechanism 114 may comprise mechanical mechanisms, such as mating threads. In another example, the attachment mechanism 114 may comprise a magnet or any other suitable attachment mechanism.

The tips 112 may further be configured so as to be in electrical communication with other elements of the extendible light 100. For example, the tips 112 may be in communication with the battery in order to receive electrical power. The tips 112 may further be in communication with the control panel 300, allowing the extendible light user to activate the tips 112 via the control panel 300, as appropriate.

Figure 4A:
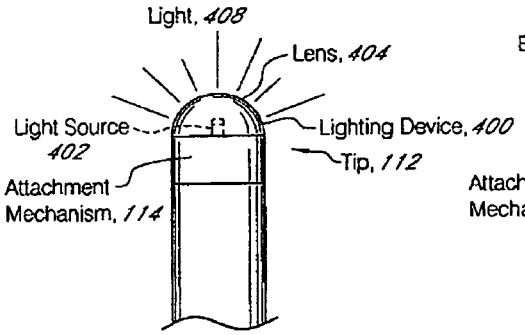
FIGS. 4A-4E illustrates embodiments of interchangeable tips of the extendible light of FIGS. 1A-1B which provide enhanced functionality.

In the embodiment of FIG. 4A, the tip 112 may comprise a lighting device 400. In one embodiment, the lighting device 400 comprises a light source 402 and an adjustable lens 404. The light source 402 may comprise any mechanism for generating light known in the art, such as incandescent bulbs and light emitting diodes (LEDs). The adjustable lens 404 may be manipulated by the user to adjust the focus of light 408 generated by the light source 402. So configured, the light 400 may provide light 408 in substantially all directions.

Figure 4B:
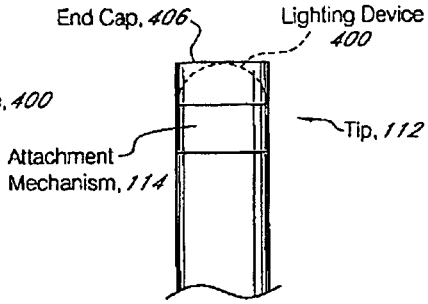

In the embodiment of FIG. 4B, the tip 112 comprises an end cap 406 that is fabricated from a wear and skid resistant material which allows the user to repeatedly press the second end 102B of the extendible light 100 into the ground to balance themselves when walking. The end cap 406 may further be hollow so as to fit around another tip 112, such as the lighting device 400, allowing each of the two tips 112 to be employed substantially concurrently. For example, the extendible light user may employ the extendible light 100 with the end cap 406 when walking and may remove the end cap 406, as needed, to employ the lighting device 400.

Figure 4C:
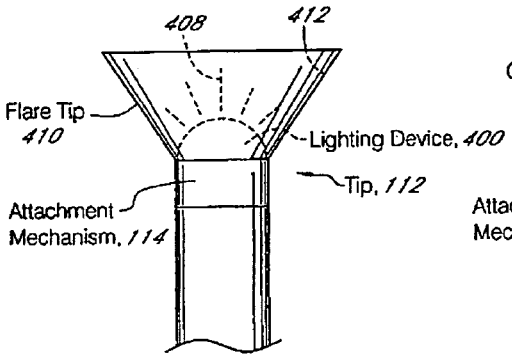

In the embodiment of FIG. 4C, the tip 112 may comprise a flare tip 410. The flare tip 410 extends generally outward from the second end 102B of the extendible light 100 in a conical configuration. In one embodiment, the flare tip 410 may be designed to direct light ahead of the extendible light, rather than in all directions, as in the embodiment of FIG. 4A. For example, an interior surface 412 of the flare tip 410 may be provided with a highly reflective surface such that light 408 emitted from the lighting device 400 that impinges the interior surface 412 is reflected in front of the extendible light 100. In alternative embodiments, the flare tip 410 may comprise a translucent material, such as a plastic or glass, configured to diffuse light impinging the flare tip 410. Such diffusion may substantially reduce glare from the light 400. The flare tip 410 may further comprise translucent material of a selected color, such as red or orange, so that light transmitted through the flare tip 410 appears as the selected color.

Figure 4D:
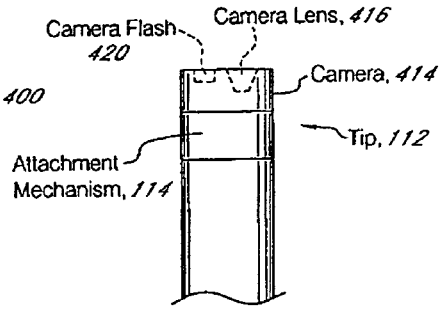

In the embodiment of FIG. 4D, the tip 112 comprises a camera 414. The camera 414 comprises a camera lens 416 and a camera flash 420. As described above with respect to the light 400, the camera 414 may be in communication with the battery for power and the control panel in order to allow the extendible light user to activate the camera.

In further embodiments, the camera 414 may comprise a still picture and/or video camera. In one embodiment, the multifunction display 302 of the control panel 300 may be used to preview images prior to taking a picture and also to review pictures taken by the camera 414. In other embodiments, the video output of the video camera may be further viewed within the multifunction display 302. A portable memory card or other memory device may also be inserted within the input/output port 316 of the control panel so as to transfer images to and from the extendible light 100.

Figure 4E:
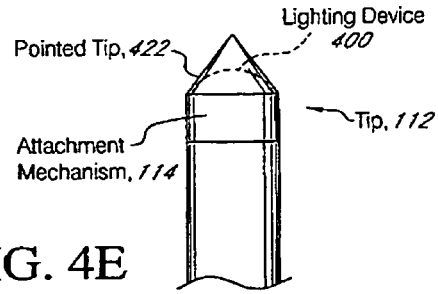

In the embodiment of FIG. 4E, the tip 112 comprises a pointed tip 422. The pointed tip 422 is configured so as to allow the user of the extendible light 100 to press the pointed tip 422 into compliant surfaces, such as earth, allowing the user to stabilize themselves with the extendible light 100. In certain embodiments, the pointed tip 422 may comprise a hard, wear resistant material such as a hard plastic, metal, or ceramic.

The embodiments of the extendible light 100 may also be configured to assist the user in a variety of dangerous circumstances. For example, as discussed below, the extendible light 100 may be provided with a plurality of sensing capabilities which identify dangers to the user and provide warnings. In alternative embodiments, the extendible light 100 may be configured so as to allow a user to signal for assistance, when needed. Thus, the embodiments of the extendible light 100 may enhance the safety of the user.

Figure 5A:
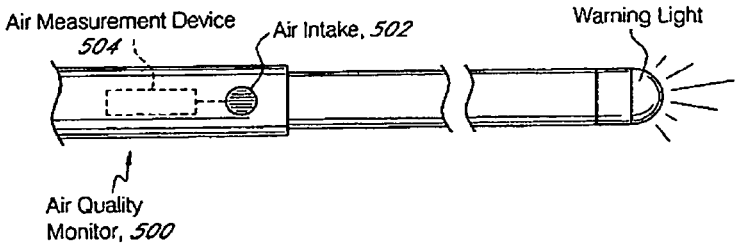
FIGS. 5A-5B illustrate embodiments of an air measurement device and warning system of the extendible light of FIGS. 1A-1B.
Figure 5B:
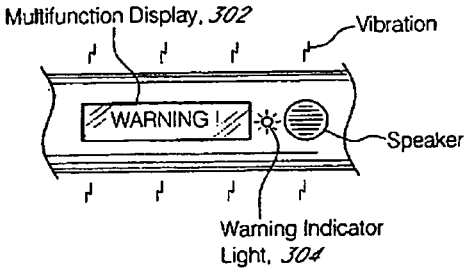

FIGS. 5A-5B illustrates an embodiment of the extendible light 100 comprising an air quality monitor 500. The air quality monitor 500 comprises an air intake 502 and an air measurement device 504. Ambient air entering the air intake 502 is conveyed to the air measurement device 504. The air measurement device 504 samples the received air for a variety of compounds which may be hazardous to the extendible light user. Examples of such compounds may include, but are not limited to, smoke, carbon dioxide, carbon monoxide, and natural gas. In an alternative embodiment, the air quality monitor 500 may be employed as a breath analyzer to provide a measure of blood alcohol content. Upon detection of one or more compounds known to be hazardous, or alcohol, in greater than a selected concentration, the air measurement device 504 may communicate with the control panel 300, indicating that a warning should be provided to the extendible light user.

The control panel 300 may provide a plurality of audio and/or visual indicators, alone or in combination, to convey a warning message to the extendible light user. In one example, the multifunction display 302 may display a warning message. In another example, one or more indicator lights 304 may flash. In a further example, the speaker 306 may provide an audio warning message. In an additional example, the handle 110 may produce a vibration 310 that may be felt by a user when touching the extendible light 100. Advantageously, such warnings may serve to enhance the safety of the extendible light user, both in outdoor environments where the extendible light 100 may be employed, such as parks and forests, as well as urban or home environments.

Figure 6A:
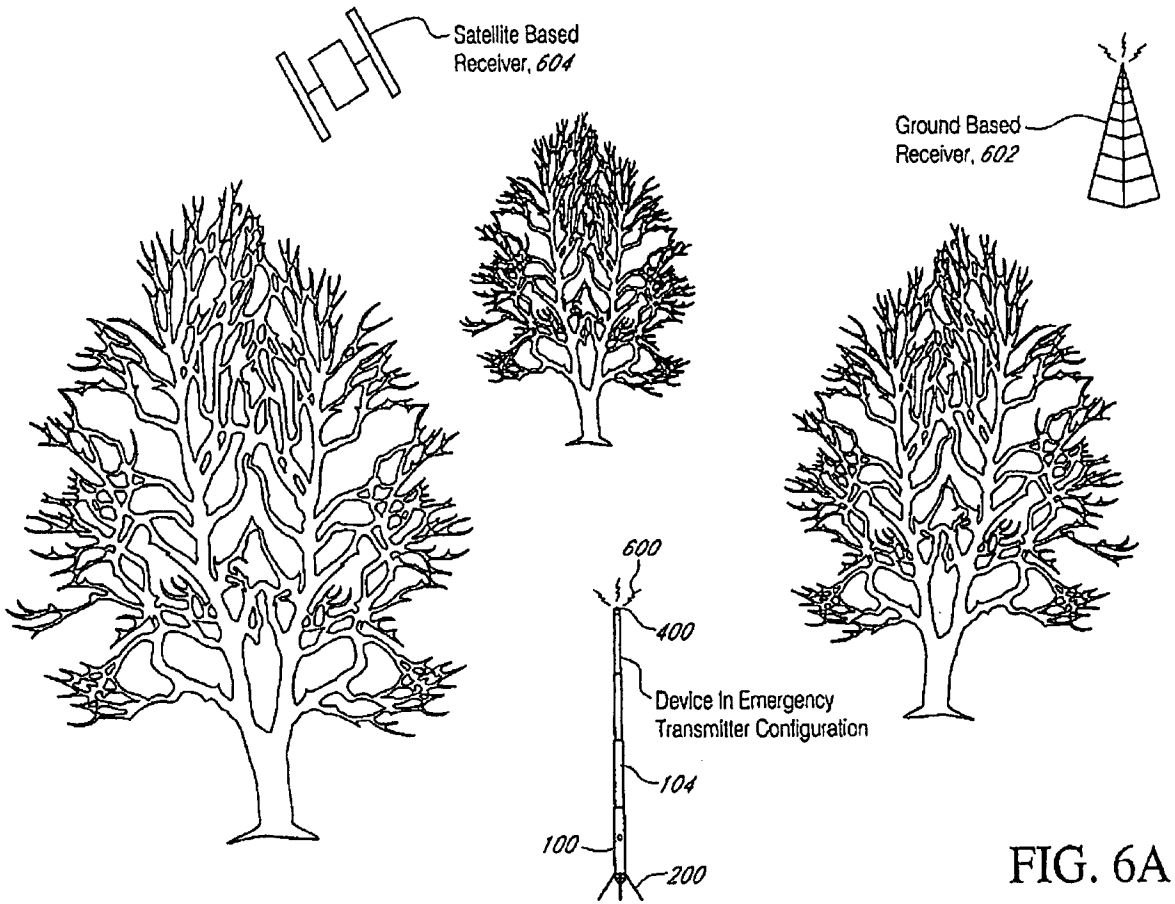
FIGS. 6A-6B illustrates functions of the extendible light of FIGS. 1A-1B; (6A) emergency transmitter; (6B) motion sensor.

In further embodiments, the extendible light 100 may be used as an emergency signaling device, as illustrated in FIG. 6A. In the embodiment of FIG. 6A, the arms 200 of the extendible light 100 are deployed and the body 104 is fully extended. The first end 102A of the extendible light 100 is further placed on the ground such that the second end 102B of the extendible light 100 extends upward. Additionally, the lighting device tip 400 of the extendible light 100 may be mounted and activated. So configured, the extendible light 100 shines a bright light in order to attract attention.

In a further embodiment, the extendible light 100 may be employed to broadcast a plurality of wireless distress signals 600 using an emergency transmitter device housed in the extendible light 100. Such a distress signal 600 may be configured for receipt by a plurality of ground-based and/or satellite-based receivers 602, 604. Upon receipt of the signal by one or more of the receivers 602, 604, rescue personnel may be deployed to the site of the extendible light 100 so as to aid the user.

Figure 6B:
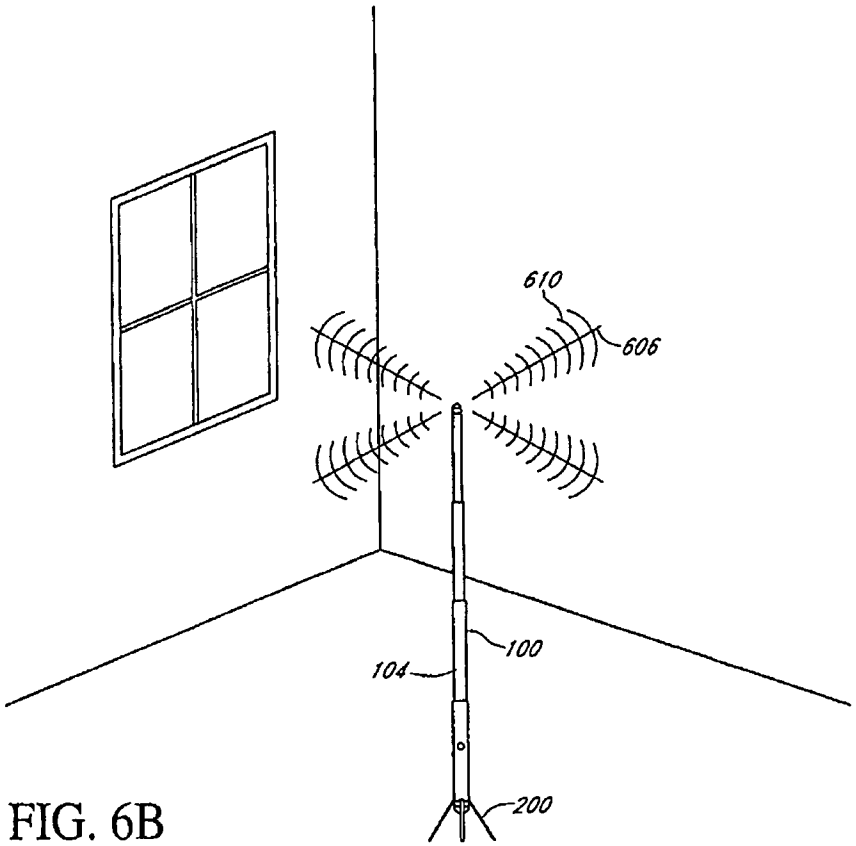

In an additional embodiment, the extendible light 100 may be employed as a motion detector. As illustrated in FIG. 6B, the extendible light 100 is placed upright, with the body 104 extended and the arms 200 deployed such that the second end 102B of the extendible light 100 extends upward. A motion detector, as known in the art, is then activated. The motion detector generates signals, such as infrared or laser beams 606 and/or acoustic waves 610 which extend outward from the extendible light 100 and allow detection of any moving objects, such as intruders, by the motion detector. When detecting a moving object, the motion detector communicates with the control panel 300 such that control panel 300 provides a plurality of audio and/or visual indicators, alone or in combination, to convey a warning message to the extendible light user, as discussed above. Thus, the motion detection capability of the extendible light may assist the extendible light user in securing a desired space, such as a room in a home or a campsite.

Although the foregoing description of certain embodiments of the present invention has shown, described and pointed out the fundamental novel features of the invention, it will be understood that various omissions, substitutions, and changes in the form of the details of the invention as illustrated as well the uses thereof, may be made by those skilled in the art, without departing from the spirit of the invention.

What is claimed is:

1. An extendible and collapsible smart light comprising;

a handle having reversibly deployable arms for hands free support of the device, wherein the handle includes a button for opening said reversibly deployable arms;

a multifunction liquid crystal display (LCD) having a programmable control panel having a processor and a memory included therein, wherein said multifunction crystal display is included on said handle;

at least two or more extendible shafts;

a battery compartment included in at least one of the two or more extendible shafts;

a lighting device included at the tip of the at least two or more extendible shafts on the end of said smart light opposite from the handle, wherein said lighting device is attached to the tip of the at least two or more extendible shafts via an attachment mechanism;

wherein said smart light is operable while it is collapsed and fully extended.

2. An extendible and collapsible smart light as in claim 1, wherein said control panel further comprises at least one or more of function from a group consisting of a LCD touch screen, USB ports, GPS tracker, power adapter input, alarm indicator light, motion sensor, an air intake measurement sensor, MP3 player with outlet, a speaker, a microphone, power bottom and a volume control button.

3. An extendible and collapsible smart light as in claim 2, comprising;

a camera, which collects data, said data being transferable from the smart light via, said USB ports.

4. An extendible and collapsible smart light as in claim 3, comprising;

an input and output port for transferring images to and from the device.

5. An extendible and collapsible smart light as in claim 1, comprising;

a means for receiving and transmitting data, wherein data is stored in said memory and is transferable to an external device.

6. An extendible and collapsible smart light as in claim 1, can be fully extended to a pre-determined length;

the device has a front end which accommodates exchangeable attachments to convert the device into a flashlight, camera, emergency flare, and a hiking and skiing light.

7. An extendible and collapsible smart light as in claim 1, comprising;

a control panel to communicate with at least one or more of function from a group consisting of a LCD touch screen, USB ports, a power button;

an intake analyzer for deoxyribonucleic acid (DNA) to identify the genetic material in an individual;

a breath-sensor analyzer to determine the intoxication level of an individual;

a voice sensor;

a retinal scanner;

a finger print scanner to capture finger print images, each function is to complete the identification process which will communicate with an approved data base.

8. An extendible and collapsible smart light as in claim 7, further comprising of a means for transmitting information and data to the appropriate law enforcement authority and provide a process to transfer the information to an external device.

9. An extendible and collapsible smart light as in claim 7, comprising;

a microphone to record the communication between law enforcement authority and persons within a vehicle.

10. An extendible and collapsible smart light as in claim 7, comprising;

a camera light attachment that collects data, said data being transferable from the smart light via said USB ports.

11. An extendible and collapsible smart light as in claim 1, comprising;

a control panel that communicates with at least one or more of function from a group consisting of a touch screen, USB ports, GPS tracker, microphone, camera, and a power button;

the device's shape is a tubular configuration;

the size of the tubular shape varies depending on the functions within said device.

12. An extendible and collapsible smart light as in claim 11, the data retrieved from the camera is transported from the device using the USB ports; a portable memory card and other memory device can be inserted within the input and output ports on the control panel so as to transfer images to and from the device.

13. An extendible and collapsible smart light as in claim 11, the device is configured to receiving and transmitting data and content, wherein information stored in the memory of the hard drive processor can be transferred into an external device;

programs can be uploaded into the device via the USB Ports.

14. An extendible and collapsible smart light as in claim 11, further comprising a lighting device at the front end of the device which accommodate exchangeable attachments to be mounted directly to the device for a flashlight, camera, emergency flare, hiking and skiing light;

the attachment mechanism comprises of mechanical mechanisms, such as mating threads and magnet mechanism, the attachments are configured to electrically communication with other elements of the device such as the battery in order to receive electrical power to the lighting device.

15. An extendible and collapsible smart light as in claim 11, the device has a rear end, which houses three deployable arms, once opened by pressing the release button, it discharges the arms and provides a stationary position for the device to be in and right position for vertical use.

16. An extendible and collapsible smart light as in claim 11, the device comprises of a GPS tracker which communication with a security company which may dispatch the appropriate law enforcement authority and emergency vehicle to the user.

17. An extendible and collapsible smart light as in claim 11, wherein said device includes an MP3 player.

18. An extendible and collapsible smart light as in claim 11, further comprising of a motion detector programmed into the device with a sensor, voice activated and a motion sensor which provides red radar for protection.

19. An extendible and collapsible smart light as in claim 11, comprising of an LCD screen as part of the control panel to give the device the ability to perform commands by wireless communication.

20. An extendible and collapsible smart light as in claim 11, further comprising a power adapter input on the control penal for recharging the battery with a standard electrical outlet and by the use of an automobile-adapter to power the battery while in a vehicle and the device may operate directly from the automobile's cigarette lighter;

the control panel is configured with a power light to indicate whether the power source is available.

21. An extendible and collapsible smart light as in claim 11, within the device, said control panel housed a speaker on the exterior of the device to provide the user with hand free communication.

22. An extendible and collapsible smart light as in claim 11, wherein said device housed on the exterior of the control panel a microphone to provide communication with hand free options while driving, walking, and hiking.

23. An extendible and collapsible smart light as in claim 11, further comprising of an alarm button on the control panel for the user to sound the alarm and communicate to the security company.

24. An extendible and collapsible smart light as in claim 11, comprising of a device consisting of an air intake measurement sensor, configured to detect smoke, carbon dioxide, carbon monoxide and natural gas programmed into the device to become activated by the sensor, an intake measurement sensor provides an alarm; this will permit the device to communicate the measurement sensor's motion detector to warn of the dangerous levels of gas it has detected.

25. An extendible and collapsible smart light as in claim 11, within said device housed on the exterior of the device is an input access for earphone and headset used to access the MP3 player and other wireless communication.

26. An extendible and collapsible smart light as in claim 11, further comprising of a battery interface from the battery compartment in the extendible shafts with one or more batteries for interfacing with the control panel, the attachments and powering the sensors with at least one battery having a positive terminal and a negative terminal;

the flashlight, emergency flare light and the hiking and skiing light attachments are configured with an incandescent bulb and light-emitting diodes (LEDs) interface ready relative to said battery compartment, electrically communicating with said battery interface, and being for interfacing with a bulb having a positive terminal and a negative terminal;

a camera attachment, which interfaced with at least one battery having a positive terminal, a negative terminal that electrically communicates with said battery interface.

27. An extendible and collapsible smart light as in claim 11, wherein said device configured for being associated with turning the device on and off by pressing the button located on the control panel down for on, then down to turn off;

the device is programmable for voice activation to turn the device on and off.

28. An extendible and collapsible smart light as in claim 11, further comprising at least one function from the group of functions to control the volume;

the functions on the LCD touch screen provide the user with the option to adjust the volume by touching a wireless communication and by the voice activation sensor.

* * * * *